US009943970B2

(12) United States Patent
Glesser

(10) Patent No.: US 9,943,970 B2
(45) Date of Patent: Apr. 17, 2018

(54) ROTATIONAL WEDGE LOCKING MECHANISM FOR A FOLDING KNIFE

(71) Applicant: Spyderco, Inc., Golden, CO (US)

(72) Inventor: Louis Sal Glesser, Evergreen, CO (US)

(73) Assignee: Spyderco, Inc., Golden, CO (US)

( * ) Notice: Subject to any disclaimer, the term of this patent is extended or adjusted under 35 U.S.C. 154(b) by 545 days.

(21) Appl. No.: 14/542,076

(22) Filed: Nov. 14, 2014

(65) Prior Publication Data

US 2016/0136824 A1 May 19, 2016

(51) Int. Cl.
*B26B 1/04* (2006.01)

(52) U.S. Cl.
CPC ..... *B26B 1/048* (2013.01); *B26B 1/04* (2013.01)

(58) Field of Classification Search
CPC ..... B26B 1/02–1/048
USPC ..... 30/155, 160–161
See application file for complete search history.

(56) References Cited

U.S. PATENT DOCUMENTS

| | | | |
|---|---|---|---|
| 462,141 | A | 10/1891 | Kruschke |
| 492,084 | A | 2/1893 | Brigham |
| 552,077 | A | 12/1895 | Wagner |
| 557,818 | A | 4/1896 | Hotchkiss |
| 589,737 | A | 9/1897 | Miller |
| 589,738 | A | 9/1897 | Miller |
| 600,442 | A | 3/1898 | Nell |
| 698,080 | A | 4/1902 | Treas |
| 736,525 | A | 8/1903 | Kaufmann |
| 749,230 | A | 1/1904 | Severance |
| 845,130 | A | 2/1907 | Schrade |
| 988,068 | A | 3/1911 | Beardsley et al. |
| 1,030,058 | A | 6/1912 | Doles |
| 1,194,503 | A | 8/1916 | Jawoisch |
| 1,362,142 | A | 12/1920 | Rohrer |
| 1,614,949 | A | 1/1927 | Finley |
| 1,803,899 | A | 5/1931 | Fuller |
| 1,864,011 | A | 6/1932 | Brown |
| 1,994,215 | A | 3/1935 | Gaunt |

(Continued)

FOREIGN PATENT DOCUMENTS

| | | |
|---|---|---|
| CA | 1130567 | 8/1982 |
| CN | 1106247 | 4/2003 |

(Continued)

OTHER PUBLICATIONS

"Dear Spyderco Customer" Letter from Spyderco, Inc., Nov. 1, 2006, 2 pages.

(Continued)

*Primary Examiner* — Laura M Lee
(74) *Attorney, Agent, or Firm* — Sheridan Ross P.C.

(57) ABSTRACT

A locking mechanism for a folding knife is provided. More specifically, the locking mechanism is a rotational wedge locking mechanism that maintains the folding knife's blade in an extended position and prevents the blade from inadvertently closing when the knife is in use in the extended position. The rotational wedge locking mechanism also impedes the folding knife from inadvertently opening when the blade is in a closed position of storage. The rotational wedge locking mechanism generally comprises a lock pin, a means for moving the lock pin, and a biasing member, which work in conjunction with the tang of the blade and the back spacer to securely retain the folding knife in an open or closed position.

20 Claims, 11 Drawing Sheets

(56) References Cited

U.S. PATENT DOCUMENTS

| | | | |
|---|---|---|---|
| 2,098,678 | A | 11/1937 | Schrade |
| 2,263,415 | A | 11/1941 | Berg et al. |
| 2,415,367 | A | 2/1947 | Pavlovic |
| 2,461,941 | A | 2/1949 | Sutton |
| 2,481,309 | A | 9/1949 | Gunnarson |
| D166,064 | S | 3/1952 | Blecher |
| 2,630,114 | A | 3/1953 | Hart |
| 2,889,621 | A | 6/1959 | Bassett |
| 3,006,443 | A | 10/1961 | Siler |
| 3,263,329 | A | 8/1966 | Hennessy |
| D224,388 | S | 7/1972 | Wood |
| D224,389 | S | 7/1972 | Wood |
| 3,731,961 | A | 5/1973 | Becker |
| D227,071 | S | 6/1973 | Bernadotte |
| 3,783,509 | A | 1/1974 | Lake |
| 3,871,141 | A | 3/1975 | Bonapace |
| D237,458 | S | 11/1975 | Laughlin |
| 3,930,309 | A | 1/1976 | Collins |
| 3,942,394 | A | 3/1976 | Juranitch |
| 4,040,181 | A | 8/1977 | Johnson |
| 4,070,011 | A | 1/1978 | Glesser |
| 4,083,110 | A | 4/1978 | Goldin et al. |
| 4,124,939 | A | 11/1978 | Onoue |
| 4,133,106 | A | 1/1979 | Addis |
| 4,170,061 | A | 10/1979 | Henry |
| D256,427 | S | 8/1980 | Lile |
| D256,981 | S | 9/1980 | Sakurai |
| D257,056 | S | 9/1980 | Spivey |
| 4,231,194 | A | 11/1980 | Glesser |
| D257,612 | S | 12/1980 | Goldin et al. |
| 4,240,201 | A | 12/1980 | Sawby et al. |
| 4,266,591 | A | 5/1981 | F'Geppert |
| 4,272,887 | A | 6/1981 | Poehlmann |
| 4,274,200 | A | 6/1981 | Coder |
| 4,347,665 | A | 9/1982 | Glesser |
| 4,356,631 | A | 11/1982 | Guth |
| 4,393,539 | A | 7/1983 | Weissman |
| 4,394,096 | A | 7/1983 | Stevens |
| 4,408,394 | A | 10/1983 | Phelps |
| 4,447,950 | A | 5/1984 | Mizelle |
| 4,451,982 | A | 6/1984 | Collins |
| D275,448 | S | 9/1984 | Ferraro |
| 4,535,539 | A | 8/1985 | Friedman et al. |
| D280,427 | S | 9/1985 | Jones |
| 4,604,803 | A | 8/1986 | Sawby |
| 4,640,058 | A | 2/1987 | Glesser |
| D288,898 | S | 3/1987 | Osterhout |
| 4,696,129 | A | 9/1987 | Roberts |
| 4,697,673 | A | 10/1987 | Omata |
| 4,703,560 | A | 11/1987 | Brooker |
| 4,719,700 | A | 1/1988 | Taylor, Jr. |
| 4,730,393 | A | 3/1988 | Coburn |
| D296,518 | S | 7/1988 | Sadler |
| 4,759,153 | A | 7/1988 | Cohen |
| 4,776,094 | A | 10/1988 | Glesser |
| 4,778,094 | A | 10/1988 | Fishback |
| 4,805,303 | A | 2/1989 | Gibbs |
| 4,811,486 | A | 3/1989 | Cunningham |
| 4,819,289 | A | 4/1989 | Gibbs |
| D302,649 | S | 8/1989 | Porsche et al. |
| D302,650 | S | 8/1989 | Giordano |
| D302,934 | S | 8/1989 | Finn |
| D303,210 | S | 9/1989 | Thompson |
| D304,154 | S | 10/1989 | Osterhout |
| 4,901,439 | A | 2/1990 | Boyd, Jr. |
| D310,014 | S | 8/1990 | Inman |
| 4,947,551 | A | 8/1990 | Deisch |
| 4,947,552 | A | 8/1990 | Barnes |
| D310,621 | S | 9/1990 | Thompson |
| 4,974,323 | A | 12/1990 | Cassady |
| 4,985,998 | A | 1/1991 | Howard |
| D317,037 | S | 5/1991 | Koshiishi |
| 5,044,079 | A | 9/1991 | Gibbs |
| 5,060,379 | A | 10/1991 | Neely |
| 5,060,890 | A | 10/1991 | Utterback et al. |
| D321,820 | S | 11/1991 | Russell |
| D324,899 | S | 3/1992 | Thompson |
| 5,093,995 | A | 3/1992 | Jan |
| 5,095,624 | A | 3/1992 | Ennis |
| 5,111,581 | A | 5/1992 | Collins |
| 5,131,149 | A | 7/1992 | Thompson et al. |
| 5,153,995 | A | 10/1992 | Opinel |
| D333,081 | S | 2/1993 | Glesser |
| D333,251 | S | 2/1993 | Glesser |
| D333,859 | S | 3/1993 | Meyer |
| D337,253 | S | 7/1993 | Glesser |
| D344,006 | S | 2/1994 | Glesser |
| 5,293,690 | A | 3/1994 | Cassady |
| D347,375 | S | 5/1994 | Sakai |
| D348,599 | S | 7/1994 | Sakai |
| 5,325,588 | A | 7/1994 | Rogers |
| D349,837 | S | 8/1994 | Glesser |
| D353,988 | S | 1/1995 | Glesser |
| 5,379,492 | A | 1/1995 | Glesser |
| D356,723 | S | 3/1995 | Sakai |
| 5,400,509 | A | 3/1995 | Collins |
| 5,425,175 | A | 6/1995 | Rogers |
| D363,871 | S | 11/1995 | Coggins |
| D365,266 | S | 12/1995 | Hasegawa |
| D366,408 | S | 1/1996 | Sessions et al. |
| D367,599 | S | 3/1996 | Sakai |
| 5,495,673 | A | 3/1996 | Gardiner et al. |
| 5,495,674 | A | 3/1996 | Taylor, Jr. |
| 5,502,895 | A | 4/1996 | Lemaire |
| 5,511,310 | A | 4/1996 | Sessions et al. |
| 5,515,610 | A | 5/1996 | Levin et al. |
| 5,537,750 | A | 7/1996 | Seber et al. |
| 5,542,139 | A | 8/1996 | Boivin |
| 5,546,662 | A | 8/1996 | Seber et al. |
| D373,716 | S | 9/1996 | Keys et al. |
| 5,572,793 | A | 11/1996 | Collins et al. |
| 5,580,019 | A | 12/1996 | Glesser |
| 5,581,888 | A | 12/1996 | Lewis |
| D377,443 | S | 1/1997 | Seber et al. |
| 5,594,966 | A | 1/1997 | Goldman |
| 5,596,808 | A | 1/1997 | Lake et al. |
| D378,982 | S | 4/1997 | Thompson |
| 5,615,484 | A | 4/1997 | Pittman |
| D379,294 | S | 5/1997 | Lum |
| 5,628,117 | A | 5/1997 | Glesser |
| D379,579 | S | 6/1997 | Pohl |
| D381,060 | S | 7/1997 | Moran |
| D382,189 | S | 8/1997 | Viele |
| D382,459 | S | 8/1997 | Khalsa |
| 5,661,908 | A | 9/1997 | Chen |
| D384,871 | S | 10/1997 | McWillis |
| D385,173 | S | 10/1997 | McWillis |
| D386,664 | S | 11/1997 | Glesser |
| 5,685,079 | A | 11/1997 | Brothers et al. |
| 5,689,890 | A | 11/1997 | Glesser |
| D387,966 | S | 12/1997 | Horn |
| D388,150 | S | 12/1997 | Glesser |
| D389,389 | S | 1/1998 | Glesser |
| D389,718 | S | 1/1998 | Wegner |
| 5,704,129 | A | 1/1998 | Glesser |
| D391,465 | S | 3/1998 | Glesser |
| D392,539 | S | 3/1998 | Balolia |
| 5,722,168 | A | 3/1998 | Huang |
| 5,737,841 | A | 4/1998 | McHenry et al. |
| 5,755,035 | A | 5/1998 | Weatherly |
| 5,765,247 | A | 6/1998 | Seber et al. |
| D396,657 | S | 8/1998 | Nagai et al. |
| D397,017 | S | 8/1998 | Pardue |
| D397,020 | S | 8/1998 | Pardue |
| 5,794,346 | A | 8/1998 | Seber et al. |
| 5,799,400 | A | 9/1998 | Glesser |
| 5,822,866 | A | 10/1998 | Pardue |
| 5,826,340 | A | 10/1998 | Hull |
| D402,178 | S | 12/1998 | Glesser |
| D402,524 | S | 12/1998 | Glesser |
| D403,567 | S | 1/1999 | Glesser |
| D404,990 | S | 2/1999 | Zowada |
| D405,338 | S | 2/1999 | Balolia |
| D407,002 | S | 3/1999 | Morton et al. |

(56) References Cited

U.S. PATENT DOCUMENTS 5,878,500 A 3/1999 Emerson
5,887,347 A 3/1999 Gibbs
D408,706 S 4/1999 Elishewitz
D409,070 S 5/1999 Elishewitz
D411,431 S 6/1999 Glesser
D411,790 S 7/1999 Glesser
D412,355 S 7/1999 Saetherbo
5,920,935 A 7/1999 Beck
5,953,821 A 9/1999 Mearns
5,964,036 A 10/1999 Centofante
5,983,506 A 11/1999 Glesser
D418,383 S 1/2000 Bradichansky
D421,378 S 3/2000 Glesser
D422,476 S 4/2000 McHenry et al.
D422,477 S 4/2000 Elishewitz
D422,478 S 4/2000 Elishewitz
D422,479 S 4/2000 Pardue
D422,480 S 4/2000 McHenry et al.
D422,669 S 4/2000 Elishewitz
D422,871 S 4/2000 Terzuola
D422,873 S 4/2000 McHenry et al.
D422,877 S 4/2000 Elishewitz
D425,389 S 5/2000 Elishewitz
D425,391 S 5/2000 Bradichansky
D426,132 S 6/2000 Pardue
6,088,861 A 7/2000 Sessions et al.
D428,789 S 8/2000 McHenry et al.
D429,138 S 8/2000 Glesser
6,101,722 A 8/2000 Cheng
6,101,723 A 8/2000 Ford
6,101,724 A 8/2000 Halligan
6,122,829 A * 9/2000 McHenry ..... B26B 1/048 30/160
D431,991 S 10/2000 Elishewitz
D432,386 S 10/2000 Elishewitz
6,125,543 A 10/2000 Jhones
D433,913 S 11/2000 Pardue
D434,631 S 12/2000 Lum
D435,420 S 12/2000 Ayoob
6,154,965 A 12/2000 Sakai
D436,014 S 1/2001 Glesser
6,170,104 B1 1/2001 Seber et al.
D438,442 S 3/2001 Osborne
D438,443 S 3/2001 Keating
6,205,667 B1 3/2001 Glesser
D441,827 S 5/2001 Frank
D442,460 S 5/2001 Glesser
D442,461 S 5/2001 Glesser
D442,841 S 5/2001 Balolia
6,305,085 B1 10/2001 Stallegger et al.
6,308,420 B1 10/2001 Moser
6,314,646 B1 11/2001 Schmidt
6,338,431 B1 1/2002 Onion
6,360,443 B1 3/2002 Remus
6,363,615 B1 4/2002 Moser
6,370,778 B1 4/2002 Conable
6,378,214 B1 4/2002 Onion
6,397,477 B1 6/2002 Collins
D461,387 S 8/2002 Glesser
6,427,335 B1 8/2002 Ralph
6,430,816 B2 8/2002 Neveux
6,438,848 B1 8/2002 McHenry et al.
D464,551 S 10/2002 Glesser
6,490,797 B1 12/2002 Lake et al.
6,523,265 B2 2/2003 Eickhorn
6,553,672 B2 4/2003 Glesser et al.
D474,669 S 5/2003 Onion
6,574,869 B1 6/2003 McHenry et al.
6,591,505 B2 7/2003 Flavigny
6,618,947 B1 9/2003 Gardiner et al.
6,675,484 B2 1/2004 McHenry et al.
6,701,621 B2 3/2004 Kain et al.
6,725,545 B2 4/2004 Frank
6,732,436 B2 5/2004 Moizis
6,751,868 B2 6/2004 Glesser
D495,940 S 9/2004 Keppel et al.
6,789,323 B2 9/2004 Moizis
6,810,588 B1 11/2004 Cheng
6,836,967 B1 1/2005 Sakai
6,918,184 B2 7/2005 Glesser
D509,124 S 9/2005 Keppel et al.
6,941,661 B2 9/2005 Frazer
6,959,494 B2 11/2005 Taylor
7,032,315 B1 * 4/2006 Busse ..... B26B 1/048 30/153
D520,843 S 5/2006 Voros
7,051,441 B2 5/2006 Carter, III
D523,317 S 6/2006 Ryan et al.
7,059,053 B2 6/2006 Sakai
7,146,736 B1 12/2006 Collins
7,243,430 B1 7/2007 Lerch
7,249,417 B2 7/2007 Chu
D553,467 S 10/2007 Ryan
7,293,360 B2 11/2007 Steigerwalt et al.
7,305,768 B2 12/2007 Hinderer
7,305,769 B2 12/2007 McHenry et al.
7,313,866 B2 1/2008 Linn et al.
7,340,836 B2 3/2008 Whitemiller et al.
D573,864 S 7/2008 Glesser
7,406,896 B2 8/2008 Rivera
7,409,766 B2 8/2008 Steigerwalt
7,437,822 B2 10/2008 Flagg et al.
D581,240 S 11/2008 Glesser et al.
7,458,159 B2 12/2008 Galyean et al.
7,533,466 B2 5/2009 Steigerwalt
7,543,386 B2 6/2009 Sullivan
7,555,839 B2 7/2009 Koelewyn
7,562,454 B2 7/2009 Steigerwalt et al.
7,562,455 B2 7/2009 McHenry et al.
7,627,951 B2 12/2009 Glesser et al.
7,676,931 B2 3/2010 Knight et al.
7,676,932 B2 3/2010 Grice
RE41,259 E 4/2010 McHenry et al.
7,694,421 B2 4/2010 Lin
7,774,940 B2 8/2010 Frank
7,905,023 B2 3/2011 Westerfield
7,918,028 B2 4/2011 Steigerwalt et al.
7,987,601 B2 8/2011 Nakamura
8,042,276 B2 10/2011 Lerch et al.
8,082,671 B2 12/2011 Saegesser
8,161,653 B2 4/2012 Nenadic
8,261,633 B2 9/2012 Maxey
8,296,958 B1 10/2012 Frazer
8,402,663 B2 3/2013 McHenry et al.
8,468,701 B1 6/2013 Perez
D686,900 S 7/2013 Ohlrich
8,505,206 B2 8/2013 VanHoy
8,572,851 B2 11/2013 Duey
8,607,460 B1 12/2013 Lerch et al.
8,646,184 B2 2/2014 Westerfield
8,745,878 B2 6/2014 Glesser et al.
8,978,253 B2 3/2015 Snyder et al.
2001/0022113 A1 9/2001 Kojima et al.
2001/0023541 A1 9/2001 Blanchard
2003/0019108 A1 1/2003 McHenry et al.
2004/0154169 A1 8/2004 McCann
2004/0231163 A1 11/2004 Sakai
2004/0244205 A1 12/2004 Linn et al.
2006/0064877 A1 3/2006 Vallotton et al.
2006/0123632 A1 6/2006 Linn et al.
2006/0168817 A1 8/2006 Kao
2006/0168819 A1 8/2006 Perreault
2006/0272158 A1 12/2006 Williams
2007/0169351 A1 7/2007 Steigerwalt
2008/0201953 A1 8/2008 Bremer et al.
2008/0222896 A1 9/2008 Marfione et al.
2008/0289198 A1 11/2008 Kaiser et al.
2009/0056146 A1 3/2009 Duey
2009/0144986 A1 6/2009 Frazer
2009/0183374 A1 7/2009 Kao
2009/0193664 A1 8/2009 Galyean
2009/0223061 A1 9/2009 Seber et al.
2009/0241348 A1 10/2009 Westerfield
2009/0271989 A1 11/2009 VanHoy

(56) References Cited

U.S. PATENT DOCUMENTS

| | | | |
|---|---|---|---|
| 2010/0236078 | A1 | 9/2010 | Duey |
| 2010/0299934 | A1 | 12/2010 | VanHoy |
| 2011/0099817 | A1 | 5/2011 | Duey |
| 2013/0125403 | A1 | 5/2013 | Westerfield |
| 2013/0233113 | A1 | 9/2013 | Saitoh |
| 2013/0263455 | A1 | 10/2013 | Collins et al. |
| 2013/0283621 | A1 | 10/2013 | Snyder et al. |
| 2013/0305541 | A1 | 11/2013 | Koenig |
| 2014/0047718 | A1 | 2/2014 | Fellows et al. |
| 2014/0115899 | A1 | 5/2014 | Frazer |
| 2014/0373364 | A1 | 12/2014 | Li |
| 2015/0128426 | A1 | 5/2015 | Sakai |

FOREIGN PATENT DOCUMENTS

| | | |
|---|---|---|
| CN | 1328021 | 7/2007 |
| CN | 1638925 | 5/2010 |
| CN | 101193730 | 5/2010 |
| CN | 101687324 | 11/2012 |
| CN | 103298589 | 9/2013 |
| DE | 3041584 | 6/1982 |
| DE | 3217529 | 1/1983 |
| DE | 3834295 | 7/1989 |
| DE | 20109376 | 8/2001 |
| DE | 69821034 | 11/2004 |
| EP | 1071546 | 1/2001 |
| EP | 2183080 | 5/2010 |
| EP | 2663430 | 11/2013 |
| FR | 829446 | 6/1938 |
| FR | 2495-986 | 6/1982 |
| FR | 2906750 | 4/2008 |
| GB | 189822620 | 12/1898 |
| GB | 578252 | 6/1946 |
| GB | 753590 | 7/1956 |
| GB | 2084058 | 4/1982 |
| JP | S56-175905 | 12/1981 |
| JP | H09-108456 | 4/1997 |
| JP | H09-511408 | 11/1997 |
| WO | WO9511116 | 4/1995 |
| WO | WO 2007/055049 | 5/2007 |
| WO | WO 2014/039254 | 3/2014 |
| WO | WO 2014/039255 | 3/2014 |
| WO | WO 2014/130333 | 8/2014 |
| WO | WO 2014/130905 | 8/2014 |

OTHER PUBLICATIONS

"Ironstone," Catalog of Knives and Accessories, Fall/Winter 1995-1996, cover, pp. 6-7 and 10-13.
"K.I.S.S. & P.E.C.K." website pages from www.crkt.com/kiss.html, dated Jun. 2, 2008, 3 pages.
"K.I.S.S. Knife from Columbia River Knife and Tool" website pages from http://www.shop.com/K_I_S_S_Knife_from_Columbia_River_Knife_and_Tool-33217878-p!.shtml, dated Jun. 2, 2008, 3 pages.
"Knives and Tools for Modern Man," The Edge Company, date unknown, p. 25.
"Latest Designs from Spyderco," date unknown, pp. 1-2.
"Spyderco 2001 Dealer Catalog," Spyderco, Inc., 2001, Part 1, pp. 1-20.
"Spyderco 2001 Dealer Catalog," Spyderco, Inc., 2001, Part 2, pp. 21-40.
"Spyderco 2001," Spyderco, Inc. 2001, 2 pages.
"Spyderco 2002," Spyderco, Inc. 2002, 3 pages.
"Spyderco 2007 Dealer Pricing," Spyderco, Inc., 2007, 4 pages.
"Spyderco 2007 Product Guide," Spyderco, Inc., 2007, Part 1, pp. 1-24.
"Spyderco 2007 Product Guide," Spyderco, Inc., 2007, Part 2, pp. 25-48.
"Spyderco 2007 Product Guide," Spyderco, Inc., 2007, Part 3, pp. 49-74.
"Spyderco 'CLIPITSTM' Flip Open With One Hand," date unknown, p. 28.
"Spyderco Think About It . . . All God's Critters Have Knives," Spyderco, Inc. 1996, 26 pages.
"Spyderco Y2K Dealer Catalog," Spyderco, Inc., 2000, Part 1, pp. 1-17.
"Spyderco Y2K Dealer Catalog," Spyderco, Inc., 2000, Part 2, pp. 18-36.
"SpyderEdge," Spyderco, Inc., 4th Quarter, 2001, pp. 1-6.
"The Bud K Catalog," Bud K Worldwide, Early Fall 2000, p. 3, front and back cover.
"To Our Valuable Distributors and Dealers," Letter from Spyderco, Inc., Nov. 1, 2006, 4 pages.
"Welcome to the World of Spyderco," Spyderco Brochure, Spyderco, Inc., 1998, 42 pages.
"Benchmade 2003 Catalog," Axis Lock, 17 pages.
Picture of a C40 Jot Singh Khalsa CLIPIT, date unknown, 1 page.
SOG Knives, Vision, retreived from http://web.archive.org/web/20020127064214/http://www.sogknives.com/vision.htm, Jan. 27, 2002, 1 page.
SOG Knives, X-ray Vision, retrived from http://web.archive.org/web/20011208114647/http://www.sogknives.com/xrayvis.htm, Dec. 8, 2001, 1 page.
SOG Knives, Mini X-Ray Vision, retrieved from http://web.archive.org/web/20011211023306/http://www.sogknives.com/minxrvis.htm, Dec. 11, 2001, 1 page.
SOG Knives, Night Vision, retrieved from http://web.archive.org/web/20011208113219/http://www.sogknives.com/nightvis.htm, Dec. 8, 2001, 1 page.
SOG Knives, Sculptura, retrieved from http://web.archive.org/web/20011211022847/http://www.sogknives.com/sculpt.htm, Dec. 11, 2001, 1 page.
Office Action for U.S. Appl. No. 12/244,151 dated Feb. 15, 2011, 7 pages.
Office Action for U.S. Appl. No. 12/244,151 dated Nov. 8, 2011, 8 pages.
Office Action for U.S. Appl. No. 12/244,151, dated Mar. 28, 2013, 6 pages.
Office Action for U.S. Appl. No. 12/244,151, dated Oct. 23, 2013, 6 pages.
Notice of Allowance for U.S. Appl. No. 12/244,151 dated Jan. 22, 2014, 5 pages.
Office Action for U.S. Appl. No. 11/759,103, dated Jan. 12, 2009, 12 pages.
Notice of Allowance for U.S. Appl. No. 11/759,103, dated Jul. 28, 2009, 14 pages.
Official Action for U.S. Appl. No. 13/460,370, dated Jun. 19, 2015 14 pages.
Official Action for U.S. Appl. No. 13/460,401, dated Apr. 24, 2014 8 pages.
Notice of Allowance for U.S. Appl. No. 13/460,401, dated Nov. 17, 2014 7 pages.
Official Action for U.S. Appl. No. 13/474,396, dated Oct. 7, 2014, 13 pages.
Official Action for U.S. Appl. No. 13/474,396, dated Mar. 27, 2015, 14 pages.
Notice of Allowance for U.S. Appl. No. 13/474,396, dated Nov. 4, 2016, 16 pages.
Official Action for U.S. Appl. No. 13/474,396, dated Jun. 22, 2016, 16 pages.
Official Action for U.S. Appl. No. 13/460,370, dated Mar. 28, 2016 18 pages.
Notice of Allowance for U.S. Appl. No. 13/460,370, dated Jul. 15, 2016 9 pages.
Official Action for U.S. Appl. No. 13/474,396, dated Aug. 13, 2015, 13 pages.
Final Official Action for U.S. Appl. No. 13/474,396, dated Oct. 27, 2015, 15 pages.
Final Official Action for U.S. Appl. No. 13/460,370, dated Dec. 15, 2015 18 pages.

* cited by examiner

ROTATIONAL WEDGE LOCKING MECHANISM FOR A FOLDING KNIFE

FIELD OF THE INVENTION

The present invention relates to cutting instruments and more specifically to folding knives with locking mechanisms to maintain extended positions of use associated with the folding knives.

BACKGROUND OF THE INVENTION

Cutting instruments have been used for centuries by craftsmen, hunters, and others requiring a sharp cutting instrument. Pocket knives are commonly used by sportsmen, craftsmen and others who desire a compact, portable blade which can be safely folded and transported in a pocket or attached to a belt. More recently, fixed length knives have been replaced with popular folding knives, which generally have two positions: open and closed. In an open or extended position of use, the knife cutting blade is extended to expose the blade cutting edge and permit cutting. In a closed position, the cutting edge of the blade is stored within a cavity or recess in the handle portion of the knife, thus preventing the blade from being exposed. The folding knife further provides a cutting instrument which is much shorter in length, when in a closed position, than a typical fixed blade knife. Although folding knives are extremely convenient, they can potentially become dangerous if the cutting blade does not have a locking mechanism to securely keep the knife blade in the extended position of use. U.S. Pat. No. 6,751,868 discloses a folding knife with a substantially spherical locking mechanism, and is incorporated by reference herein in its entirety.

Although there are other types of locking mechanisms used to prevent the inadvertent closure of a folding knife blade, such as a liner lock, which utilizes a leaf spring positioned within the cavity of the knife handle and which engages the heel end of the knife blade, or a single piece backlock, which utilizes a locking bar positioned along an upper edge of the knife handle, many of these locking mechanisms are not simplistic to use, are expensive to manufacture, or are prone to failure. Additionally, with both liner locks and backlock locking mechanisms, it is possible for the locking apparatus to potentially become disengaged from the blade after excessive and continuous use. Thus, there is a need for a type of folding knife locking mechanism which overcomes these pitfalls and is simplistic to use, inexpensive to manufacture, and provides substantial strength to prevent any inadvertent failure. There is also a need for an improved folding knife locking mechanism that is simplistic to assemble, uses a minimum number of components, and is extremely reliable to prevent the inadvertent closure of the knife blade. There is an additional need for a lock release mechanism that allows quick and easy manipulation by a user's thumb on a side of the folding knife handle to assure quick closing.

SUMMARY OF THE INVENTION

More specifically, by utilizing a rotational wedge locking mechanism comprising a pin to engage both a surface of the blade tang and a surface of the back spacer, a folding knife with superior strength characteristics can be manufactured, and with improved locking durability. The rotational wedge locking mechanism may also be referred to as a "roto wedge locking mechanism" herein.

It is thus an aspect of embodiments of the present invention to provide a folding knife locking mechanism that is secure, strong, safe, and easily released when the blade is in an extended position of use. It is a further aspect of the present invention to provide a folding knife locking mechanism with increased compression force, improved durability, and designed to use a minimum number of components, thus making the locking mechanism inexpensive to manufacture, simplistic in design, and encompassing a variety of different embodiments of a folding knife or multi-tool.

It is also one aspect of embodiments of the present invention to provide a locking mechanism that is near frictionless when moving between open and closed positions to allow the blade to open or close with relative ease. Thus, the locking mechanism may be a roto wedge locking mechanism with a lock release mechanism allowing easy manipulation by a user's thumb on a side of the folding knife handle to assure quick closing.

Yet another aspect of embodiments of the present invention is to provide a folding knife with safe locking and unlocking features and with a reduced number of components. Thus, the folding knife may have a rotational wedge locking mechanism with as few as two components, which enable the blade to pivot about a fixed point, safely secure the blade in an extended position of use, and prevent the inadvertent opening of the blade when the blade is in a closed position by impeding rotation of the blade when it is in a closed position of storage. Please note that "open" may be used herein interchangeably with "extended" when referring to the blade or knife position.

It is a further aspect of the present invention to provide a locking mechanism that has a biasing means which continually biases the locking mechanism to secure the blade in an extended position, such that the blade cannot be inadvertently closed. To release the blade from its extended position, the locking mechanism must be engaged by a user's thumb or finger and pushed and/or rotated in a predetermined direction by the user, which makes it substantially impossible for the knife locking mechanism to fail. Alternatively, the locking mechanism may be oriented in numerous different directions to accommodate certain handle and blade designs, and may be used without any type of biasing means.

One aspect of embodiments of the present invention is to provide a roto wedge locking mechanism retained within the handle portion of the folding knife, such as by enclosing the locking mechanism between a pair of scales. It is another aspect of embodiments of the present invention to provide a locking mechanism for a folding knife or multi-tool that has improved user access on a side of the handle for easy access by a user's thumb. Thus, a user can unlock and release the blade with ease and comfort. The lock release mechanism may be positioned immediately adjacent to a user's thumb or finger, and may be accessed on one side of a folding knife handle. Alternatively, the lock release mechanism may be accessed on both sides of the handle.

Another aspect of embodiments of the present invention is to provide a folding knife locking mechanism having a lock pin with a portion that extends outwardly from the handle such that a user may use the lock pin to release the locking mechanism and close the blade. Further, the lock pin provides a position indicator for the locking mechanism by showing whether the blade is locked.

One aspect of some embodiments of the present invention is to provide a folding knife where the space between the tang of the blade and the back spacer is reduced in one direction to form a "lock" such that a moveable lock pin may be "wedged" into the reduced space to prevent rotation of the blade. The rotational wedge locking mechanism may comprise one or more bars (also called a "lock bar" herein), a pin (also called a "lock pin" herein), and a back spacer (also called a "spacer" herein). The bar and pin of the rotational wedge locking mechanism lock the blade in an extended position using compression force.

A further aspect of various embodiments of the present invention is to provide a folding knife comprising a locking mechanism for preventing rotation of the blade by engagement with at least one surface of the tang of the blade and at least one surface of the back spacer, thereby securing the folding knife in an extended position of use. The locking mechanism may engage both the tang of the blade and the back spacer such that the tang and the back spacer provide compression forces on the locking mechanism, which thus provides improved locking features.

One aspect of some embodiments of the present invention is to provide a folding knife with a roto wedge locking mechanism that is biased with a biasing member. The biasing member, which may be a leaf spring or other biasing means, provides a forwardly-oriented force on the lock bar and lock pin to keep the roto wedge locking mechanism in a locked positioned when the blade is in an open position of use and to keep the lock pin biased against a notch in the blade when the blade is in a closed position. Thus, the biasing force on the lock bar and lock pin is oriented in a forwardly-oriented rotational direction toward the reduced space between the tang and back spacer. Note that "forward" refers to the tip of the blade and rearward refers to the butt end of the handle.

It is another aspect of embodiments of the present invention to provide a blade locking mechanism that serves the dual purpose of locking a folding knife blade in an extended position of use and simultaneously serves as a stop pin, which eliminates the additional stop pin component. Thus, a locking mechanism is provided which has a back spacer with (1) a lower surface to engage a lock pin to prevent inadvertent closure of the blade and (2) a stop surface to engage a vertical surface of the heel of the blade to prevent over-extension of the blade.

In various embodiments of the present invention, a folding knife with a locking mechanism is provided. The locking mechanism is a rotational wedge locking mechanism and comprises a lock bar interconnected to a lock pin positioned between at least one interior surface of the blade tang and at least one interior surface of the back spacer such that the rotational wedge locking mechanism prevents the folding knife blade from pivoting from an open, extended position to a closed position. The rotational wedge locking mechanism also impedes the opening of the blade when the blade is in a closed, stored position.

In one embodiment of the present invention, the tang of the blade comprises a flat surface, a curved surface, and a bump. The bump may be positioned proximate to the flat surface such that when the blade is in an extended position of use and the lock pin is resting on the flat surface, the bump prevents the lock pin from moving further into the reduced space between the tang and the back spacer. Thus, the bump may act like a stop by making the space too small for the lock pin to enter.

When the folding knife blade is in an open, extended position of use (also referred to herein as an "open and locked position," "a first position," or "a first extended position"), the locking mechanism is in a first locked position, the lock bar is in a first locked position, and the lock pin is in a first locked position. When the lock bar is in the first locked position, a first side of the lock pin is positioned against a flat surface of the tang of the blade such that the first side of the lock pin is in compression with the tang and a second side of the lock pin is positioned against a lower surface of the back spacer such that the back spacer is in compression with the second side of the lock pin, thereby preventing the blade from pivoting about a blade pivot point (e.g., a fixed pivot pin) and rotating to a closed position. The flat surface of the tang may be upwardly oriented in some embodiments or oriented upwardly and at an angle in other embodiments. Additionally, the lock pin is positioned in a forward portion of a slot of the handle when the lock bar is in the first locked position and the fixed pivot pin is centrally positioned within a slot of the lock bar. This positioning of the lock pin wedged between the tang of the blade and the back spacer significantly improves the strength characteristics of the locking mechanism, and more specifically it improves the knife's strength characteristics with respect to compressive force when pressure is applied to the spine of the blade.

When the folding knife is in an open position, the user may push on the lock pin to slide and rotate the lock bar and lock pin around the fixed pivot pin to unlock, disengage, or release the locking mechanism. It is known to use linear motion to disengage a folding knife locking mechanism; however, no other locking mechanisms use linear motion and rotational motion to disengage the locking mechanism. Thus, when the locking mechanism is unlocked or released and the folding knife is in an open position or in an intermediate position between open and closed, the locking mechanism is in a second released position, the lock bar is in a second released position, and the lock pin is in a second released position. When the locking mechanism is in the second released position, the first side of the lock pin is positioned against a curved surface of the tang such that the blade may pivot around the fixed pivot pin. Additionally, the lock pin is positioned in a central portion of the slot in the handle when the lock bar is in the second released position and at least a part of the fixed pivot pin is positioned within a forward portion of the slot in the lock bar.

Similarly, when the folding knife is in a closed position, the locking mechanism is in a third resting position, the lock bar is in a third position, and the lock pin is in a third position. When the lock bar is in the third position, the lock pin is positioned against a notch in the tang of the blade, thereby creating an additional safety feature which prevents the inadvertent opening of the blade. A leaf spring may further bias the lock pin against the notch of the tang. Additionally, when the folding knife is in a closed position, a contact surface of the blade is positioned against an interior surface of the back spacer to prevent the blade from pivoting about the blade pivot point beyond the blade's closed position.

When the user wants to rotate the blade from the closed position to the open position, the user may pull on the blade, and more specifically pull on the spine of the blade, a thumb stud, a dimple in the blade, a finger aperture in the blade, or any other mechanism that may help the user rotate the blade. As the blade rotates to the open position, the notch in the tang carries the lock pin in a rotational direction around the fixed pivot pin to a lower, rear portion of the slot in the handle until the tang rotates past a position where the notch can no longer carry the lock pin. At this point, the notch releases the lock pin and the lock pin is pulled upwardly within the slot in the handle by the leaf spring and the blade is free to rotate about the fixed pivot pin to an open position.

In some embodiments of the present invention, a folding knife is provided with a blade that a user may move from an open position to a closed position by pushing in a rearward direction on a lock pin extending outwardly from one or both sides of the handle near a forward end (also referred to herein as a "forward portion," "front portion," or "front end") of the handle. The lock pin may also be positioned proximate to the tang of the blade. As the user engages or pushes rearwardly on the lock pin, the lock bar and the lock pin rotate around and slide linearly along a blade pivot point (e.g., a fixed pivot pin or rivet) to a second released position such that the lock pin disengages both the flat surface of the tang of the blade and the lower surface of the back spacer. At this point, the locking mechanism is in a second released position which allows the blade to rotate to either an extended position of use or closed position of storage. The term "unlocked," as used herein, may be used interchangeably with "released" when referring to the locking mechanism.

In one embodiment of the present invention, a roto wedge locking mechanism is provided comprising one or more lock bar members interconnected to a lock pin member. Alternatively, the roto wedge locking mechanism may comprise one or more teardrop-shaped or egg-shaped lock bar members, one or more rectangular lock bar members, or one or more lock bar members of any other imaginable shape that can be rotated and slid along a fixed pin. In some embodiments, the roto wedge locking mechanism comprises a lock pin, ball, lever, cube, or a lock pin member of any other imaginable shape that can be interconnected to a lock bar member and moved by a user to engage or disengage the tang of the blade.

In some embodiments, the lock pin may engage one end of a biasing member. A back spacer may receive the other end of the biasing member. The back spacer may also be referred to as a "spacer" herein. The biasing member may be in constant tension to impede the lock pin's movement around and along the fixed pivot pin toward an unlocked position. In one embodiment, the biasing member may be coupled to the lock pin or a lock bar member to provide an upwardly and/or forwardly-oriented force on the lock pin or lock bar member. In some embodiments, the locking mechanism, biasing member, and back spacer may be concealed within the handle of the folding knife. In one embodiment, the biasing member is a leaf spring. Other biasing members, such as other springs or coil springs could be used in alternate embodiments.

In various embodiments, the blade, lock bar, lock pin, scales, and leaf spring may be composed of various materials known in the art. For example, some components may be metal, ceramic, plastic, fiberglass, or any other known material. The locking mechanism components are generally comprised of a metallic material such as stainless steel. However, other materials resistant to compressive forces could be used for the same purpose.

In one embodiment of the present invention, a folding knife with a selectively releasable locking mechanism is provided comprising: a blade moveable from a first extended position to a second closed position and having a front end, a tang on a rear end, a spine, and a cutting edge; a handle having a slot, a cavity for receiving a portion of the blade, and a back spacer, where the blade is pivotally interconnected to a forward end of the handle at a pin; a locking mechanism moveable from a first locked position to a second released position, the locking mechanism comprising: a lock bar positioned proximate to the forward end of the handle, the lock bar having a slot and the pin positioned within the slot of the lock bar, where the lock bar is moveable in a rotational direction around the pin and linearly along the pin; and a lock pin interconnected to the lock bar and positioned proximate to one end of the lock bar, where the lock pin extends outwardly from the handle through the slot of the handle; where when the blade is in the first extended position a first side of the lock pin engages a first upwardly-oriented surface of the tang and a second side of the lock pin engages a lower surface of the back spacer; and where when the locking mechanism is in the second released position the lock pin disengages the first upwardly-oriented surface of the tang and disengages the lower surface of the back spacer.

In further embodiments of the present invention, the folding knife with a selectively releasable locking mechanism may comprise a biasing member interconnected to the lock pin and the back spacer, a biasing member that biases the lock pin upwardly and forwardly, and/or a second lock bar interconnected to the lock pin, where the first lock bar is positioned on a first side of the tang and the second lock bar is positioned on a second side of the tang. In some embodiments, when the locking mechanism is moved from the first locked position to the second released position, the lock bar moves linearly along the pin and the lock bar rotates around the pin. Additionally, the lock pin disengages the first upwardly-oriented surface of the tang when the lock pin is pushed in a rearward direction. In other embodiments, when the locking mechanism is in the second released position the lock pin engages a curved surface of the tang and when the blade is in the second closed position a notch portion of the tang engages the lock pin. Further, the lock pin is in compression with the first upwardly-oriented surface of the tang and the lower surface of the back spacer when the blade is in the first extended position.

In another embodiment of the present invention, a folding knife with a locking mechanism is provided comprising: a blade having a front end, a tang on a rearward end, an upper edge, and a cutting edge; a pin; a handle comprising a back spacer, a first scale, and a second scale, where the tang of the blade is pivotally interconnected to a forward end of the handle at the pin; a locking mechanism comprising a lock bar and a lock pin, the locking mechanism pivotally interconnected to the handle for selectively locking the blade in a first extended position and selectively allowing the blade to rotate to a second closed position, the lock pin interconnected to an end portion of the lock bar; a space between the tang and the back spacer, the space reducing in size in a forward direction; a flat surface of the tang; a first surface of the lock pin adapted to provide a compression force against the flat surface of the tang when the blade is in the first extended position; a second surface of the lock pin adapted to provide a compression force against a lower surface of the back spacer when the blade is in the first extended position; where when the blade is in the first extended position, the lock pin is positioned in the space; and where when the lock pin is pushed rearwardly, the lock pin disengages the flat surface of the tang and the lower surface of the back spacer.

According to one embodiment of the present invention, the folding knife further comprises a biasing member interconnected to the lock pin and the back spacer, where the biasing member biases the lock pin forwardly. Additionally, the back spacer may be positioned between the first and second scales and the first and second scales define a channel for receiving at least a portion of the blade.

In yet further embodiments, the lock pin disengages the flat surface of the tang when the lock pin is pushed in a rearward direction and when the blade is in the second closed position a notch portion of the tang engages the lock pin. In an additional embodiment of the present invention, the folding knife also comprises a slot to engage the pin and to allow for linear and rotational movement of the lock bar around the pin second lock bar interconnected to the lock pin, where the first lock bar is positioned on a first side of the tang and the second lock bar is positioned on a second side of the tang and the first scale comprises a cutout shaped to accommodate the first lock bar, and where the second scale comprises a cutout shaped to accommodate the second lock bar.

In one embodiment of the present invention, a locking mechanism for a folding knife is provided comprising: a first lock bar positioned proximate to a tang of a blade, the first lock bar having a slot; a second lock bar positioned proximate to the tang of the blade, the second lock bar having a slot; a first pin positioned within the slot of the first lock bar and the slot of the second lock bar, where the first and second lock bars are moveable in a rotational direction around the first pin and linearly along the first pin; a lock pin interconnected to the first and second lock bars and positioned proximate to an end of the first lock bar and an end of the second lock bar, where the lock pin extends outwardly from a handle through a slot of the handle; a biasing member which biases the lock pin upwardly and forwardly; where when the blade is in a first extended position a first side of the lock pin engages a first upwardly-oriented surface of the tang and a second side of the lock pin engages a lower surface of a back spacer; where when the locking mechanism is in a second released position the lock pin disengages the first upwardly-oriented surface of the tang and disengages the lower surface of the back spacer; and where when the blade is in a second closed position a notch portion of the tang engages the lock pin.

In some embodiments, the lock pin disengages the first upwardly-oriented surface of the tang and the lower surface of the back spacer when the lock pin is pushed in a rearward direction. Further, when the blade is in the first extended position a third surface of the lock pin engages a bump on the tang.

U.S. Pat. No. 6,553,672 to Glesser et al. discloses a folding knife with a compression locking mechanism, and is incorporated by reference herein in its entirety. U.S. Pat. No. 6,918,184 to Glesser discloses a folding knife lock integral stop pin, and is incorporated by reference herein in its entirety. U.S. Pat. No. 6,751,868 to Glesser discloses a folding knife with a substantially spherical locking mechanism, and is incorporated by reference herein in its entirety. U.S. Pat. No. 5,615,484 to Pittman discloses a cam lock for a folding knife blade, and is incorporated by reference herein in its entirety. U.S. Pat. No. 4,985,998 to Howard discloses a folding knife with a blade lock, and is incorporated by reference herein in its entirety.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. §112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and Detailed Description and no limitation as to the scope of the present invention is intended by either the inclusion or non-inclusion of elements, components, etc. in this Summary of the Invention. Additional aspects of the present invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1A:
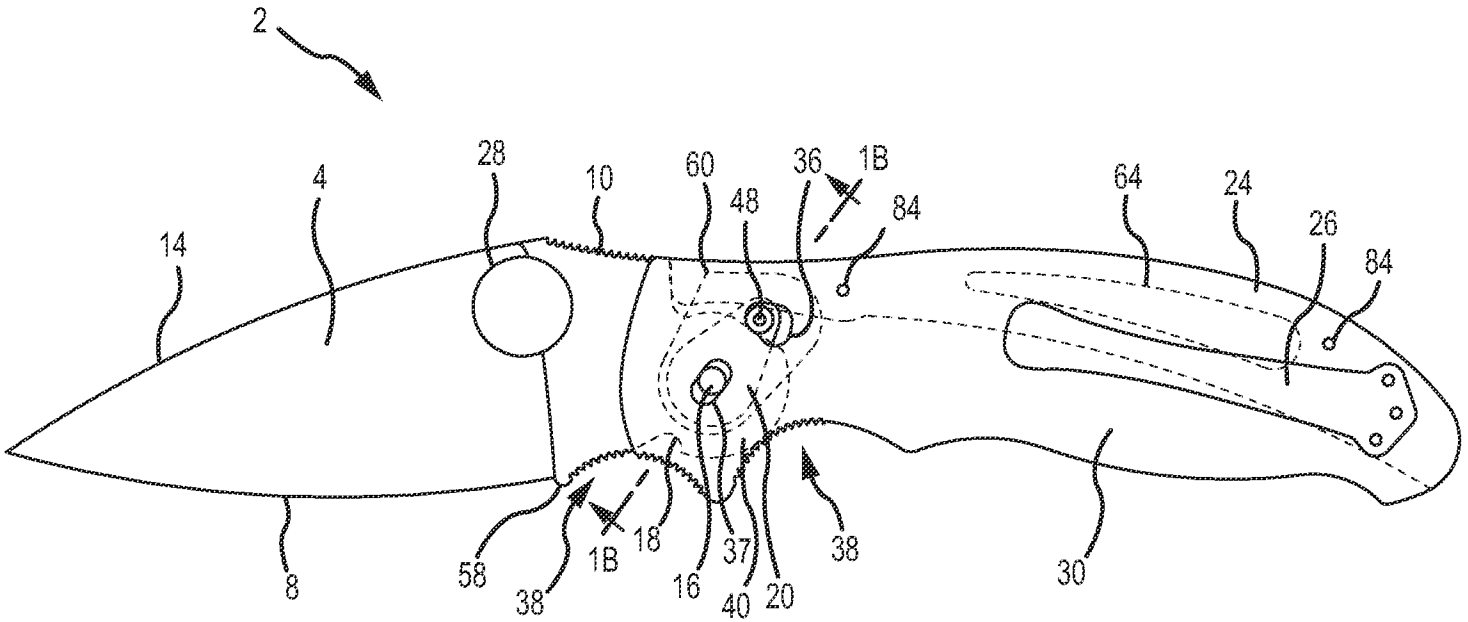
FIG. 1A is a front elevation view of a folding knife in an extended position.

To assist in the understanding of the embodiments of the present invention the following list of components and associated numbering found in the drawings is provided herein:

| Component No. | Component |
|---|---|
| 2 | Folding Knife |
| 4 | Blade |
| 6 | Vertical Edge (of Blade) |
| 8 | Cutting Edge (of Blade) |
| 10 | Thumb Traction Portion (of Blade) |
| 12 | Recessed Blade Portion |
| 14 | Spine (of Blade) |
| 16 | Fixed Pivot Pin (Blade Pivot Point) |
| 18 | Notch (of Tang) |
| 20 | Lock Bar |
| 22 | Leaf Spring |
| 24 | Back Spacer |
| 26 | Clip |
| 28 | Finger Aperture |
| 30 | Handle |
| 34 | Stop Surface (of Back Spacer) |
| 36 | Slot (of Handle) |
| 37 | Slot (of Lock Bar) |
| 38 | Choil |
| 40 | Tang |
| 42 | Bump (of Tang) |
| 46 | Flat Surface (of Tang) |
| 48 | Lock Pin |
| 56 | Curved Surface (of Tang) |
| 58 | Contact Surface (of Blade) |
| 60 | Cutout (in Inner Handle) |
| 62 | Lower Surface (of Back Spacer) |
| 64 | Aperture (of Back Spacer) |
| 84 | Pin (of Spacer) |
| 86 | Right Scale |
| 88 | Left Scale |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

As described in detail below, various embodiments of the present invention include novel folding knife designs and configurations, comprising a rotational wedge locking mechanism and/or other features. The present invention has significant benefits across a broad spectrum of endeavors.

Referring now to the drawings, FIG. 1A is a front elevation view of one embodiment of a folding knife 2 in a first extended position of use. The dotted lines in FIG. 1A show components beneath the handle 30 and which are not visible in normal use. The folding knife 2 generally comprises a blade 4 that is rotatably interconnected to a handle 30. The blade 4 is pivotable about a fixed pivot pin 16 (also called a "blade pivot point" herein) allowing the blade 4 to be positioned in a closed (FIG. 2) or open (FIG. 1A) position, and rotated therebetween. The blade includes a spine 14, a cutting edge 8, which is typically sharpened and opposite the spine 14, a thumb traction portion 10 (also called a thumb ramp), and a blade tang 40 positioned proximate to the heel end of the blade 4. In some embodiments, the thumb traction portion 10 is located on the spine 14 of the blade proximate the handle 30. The thumb traction portion 10 gives the user's thumb some traction, which can enhance the user's grip when thrusting and stabbing. The rotational wedge locking mechanism may comprise a lock bar 20 and a lock pin 48.

The tang 40 is comprised of multiple surfaces: a flat surface 46, a curved surface 56, and a notch 18. The flat surface 46 engages the lock pin 48 when the blade 4 is in an open position to prevent the blade 4 from inadvertently rotating to the closed position. The curved surface 56 is interconnected to the flat surface 46 and allows the tang 40 to rotate around the fixed pivot pin 16 and along the lock pin 48. The various surfaces of the tang 40 engage one or more components of the roto wedge locking mechanism. For example, the flat surface 46, the curved surface 56, and a bump engage the lock pin 48 when the blade 4 is in some positions and the notch 18 engages the lock pin 48 when the blade 4 is in other positions. The lock pin 48 may be interconnected to or retained within an aperture in the lock bar 20. Some embodiments of the present invention include two lock bars 20—each lock bar 20 is positioned on either side of the tang 40. Each scale has a cutout 60 in its inner surfaces to accommodate the lock bar 20 on its respective side of the tang 40. The lock bar 20 can rotate around and move linearly along the fixed pivot pin 16. The lock bar 20 also has a slot 37 to accommodate and move around the fixed pivot pin 16. Thus, the fixed pivot pin 16 is positioned within the slot 37 of the lock bar 20. The locking mechanism is discussed in more detail below in connection with FIGS. 3A-7.

In one embodiment, the blade 4 includes a contact surface 58 for contacting an interior component of the folding knife 2 when the blade 4 is in a closed position. In the embodiment shown, the interior component is a back spacer 24. Thus, the contact surface 58 engages a lower surface of the back spacer 24 when the blade 4 is in the closed position. The blade 4 may also comprise a finger aperture 28, which may assist a user in rotating the blade 4 about the fixed pivot pin 16 from the closed position to the open position of use. In some embodiments, the blade 4 further includes bevels.

The blade 4 and handle 30 may be shaped such that they form a choil 38 on the lower side of the folding knife 2 proximate the cutting edge 8 of the blade. The choil 38 may include a traction surface to further assist the user in gripping the folding knife 2 and the choil 38 may be adapted to receive a user's finger. One exterior surface of the handle 30 may include a clip 26. The handle 30 may comprise a back spacer 24 and surfaces, or machined sections of a folding knife often referred to as scales, which are formed into the interior surface of the handle portions of the folding knife 2. In some embodiments, the handle 30 may comprise a right and a left scale. The back spacer 24 may have an aperture 64 to reduce the weight of the back spacer 24 without reducing the strength of the back spacer 24. In some embodiments, the back spacer 24 is interconnected to the scales using pins 84 or other interconnection means. At least one side of the handle 30 may further comprise a slot 36 to accommodate lateral and rotational movement of the lock pin 48. The lock pin 48 may assist in retaining the locking mechanism within the handle 30. In alternate embodiments, the locking mechanism may be interconnected to the knife handle 30 by flues, adhesives, or epoxies.

Figure 1B:
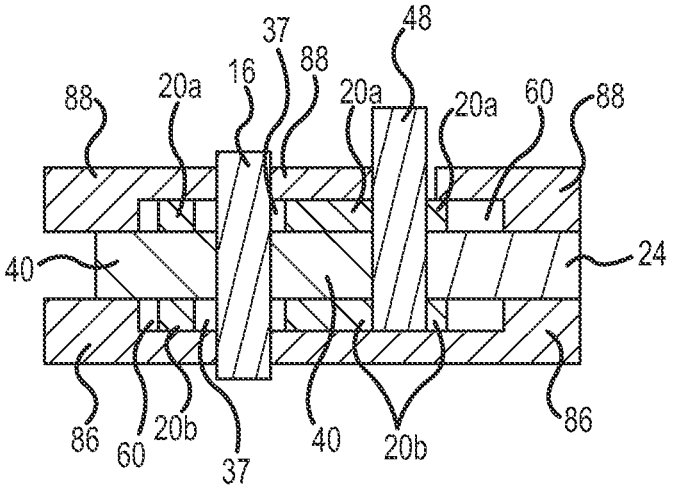
FIG. 1B is a cross-sectional elevation view of the folding knife along cut 1B-1B of FIG. 1A.

FIG. 1B is a cross-sectional elevation view of the folding knife along line 1B-1B of FIG. 1A. Cut 1B-1B is along the longitudinal axis of the lock bar 20. The view in FIG. 1B shows the tang 40 of the blade, the left scale 88, the right scale 86, the lock bar 20, the back spacer 24, the fixed pivot pin 16, and the lock pin 48. As can be seen in FIG. 1B, some embodiments of the roto wedge locking mechanism have two lock bars 20*a*, 20*b*, with one on either side of the tang 40. Each lock bar 20*a*, 20*b* fits in a cutout 60 in the inner handle. Thus, each scale 86, 88 has a cutout 60 to accommodate its respective lock bar 20*b*, 20*a*. The slots 37 in the lock bars 20*a*, 20*b* allow the lock bars 20*a*, 20*b* to move around (rotational direction) and along (lateral direction) the fixed pivot pin 16. The slot 36 in the handle and the slot 37 in the lock bar 20 are sized and shaped such that the lock bar 20 and lock pin 48 can rotate around the fixed pivot pin 16 and move linearly along the fixed pivot pin 16. FIG. 1B shows the lock pin 48 positioned securely between the back spacer 24 and the tang 40 of the blade when the folding knife is in an open and locked position. In the embodiment shown in FIG. 1B, the lock pin 48 is accessible by a user via one side of the folding knife, i.e., on the left side of the handle. In other embodiments, the lock pin 48 may be accessible on the right side of the folding knife's handle or on both sides of the handle.

Figure 2:
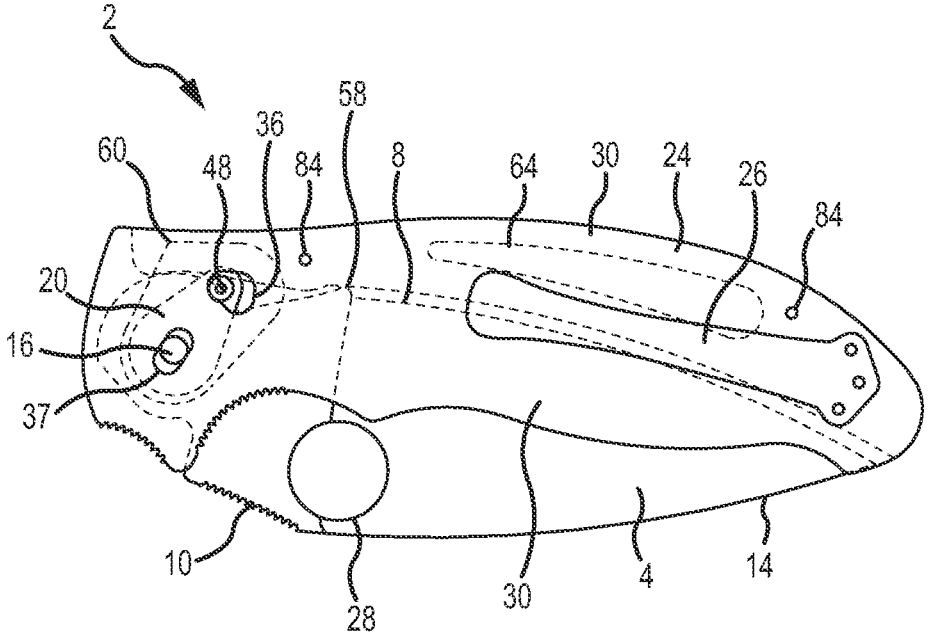
FIG. 2 is a front elevation view of the folding knife of FIG. 1A shown in a closed position.

Referring now to FIG. 2, the folding knife 2 of FIG. 1A is shown with the blade 4 in a second closed position. The dotted lines in FIG. 2 show components beneath the handle 30 and which are not visible in normal use. The blade 4 is pivotable about a fixed pivot pin 16 allowing the blade 4 to be positioned in a closed (FIG. 2) or open (FIG. 1A) position, and rotated therebetween. In the closed position, the blade cutting edge 8 is located within a cavity in the handle 30, and thus prevents a user from inadvertently being cut or injured. The tang 40 of the blade 4 is rotated around the fixed pivot pin 16 and concealed within the handle 30 when the knife 2 is in the closed position. Additionally, a contact surface 58 of the blade 4 is positioned against a surface of the back spacer 24 to prevent the blade 4 from pivoting about the blade pivot point 16 beyond the blade's closed position. In some embodiments, the spine 14 of the blade 4, the thumb traction portion 10, and the finger aperture 28 are exposed when the blade 4 is in the closed position.

Although FIGS. 1A-2 have shown a folding knife 2 comprising a handle 30, it is contemplated that a folding knife 2 according to one embodiment of the present disclosure will include a blade 4 that may be coupled to a significantly modified handle, different from the handle depicted in FIGS. 1A-2, including but not limited to a handle comprised of only a first surface, but that still has the ability to secure the blade 4 in a closed position or an open position as described above (i.e., provides a blade attachment or pivot point and the ability to recess the blade).

FIGS. 3A-7 show the rotational wedge locking mechanism in different positions. The handle 30 (or left scale 88) is removed in these figures for clarity. However, the left scale and slot 36 therein are shown in phantom (dotted lines) for reference. Portions of the tang 40 and back spacer 24 positioned behind the lock bar 20 are also shown in dotted lines for reference purposes.

Referring to FIGS. 3A-7, the following descriptions of the positions of various components will be used herein. When the folding knife 2 and blade 4 are in a first extended position of use (FIGS. 1 and 3A), the roto wedge locking mechanism is in a first locked position, the lock bar 20 is in a first locked position, and the lock pin 48 is in a first locked position. Additionally, a first side of the lock pin 48 is positioned against a flat surface 46 of the tang 40 of the blade 4 such that the lock pin 48 is in compression with the tang 40 and a second side of the lock pin 48 is positioned against a lower surface 62 of the back spacer 24 such that the back spacer 24 is in compression with the lock pin 48, thereby preventing the blade 4 from pivoting about a fixed pivot pin 16 and rotating to a closed position. The flat surface 46 of the tang 40 may be upwardly oriented or oriented upwardly and at an angle. The lock pin 48 is positioned in a forward portion of a slot 36 in the handle 30 when the lock bar 20 is in the first locked position and the fixed pivot pin 16 is positioned within a central portion of a slot 37 of the lock bar 20. When the folding knife blade 4 is in a first extended position of use and the roto wedge locking mechanism is in the first locked position, the lock pin 48 is wedged between the tang 40 of the blade 4 and the back spacer 24, which significantly improves the strength characteristics of the locking mechanism.

When the folding knife 2 is locked in the first extended position of use, the user may push on the lock pin 48 to slide and rotate the lock bar 20 and lock pin 48 around the fixed pivot pin 16 to unlock or release the rotational wedge locking mechanism. Thus, when the folding knife is in an open, extended position or in an intermediate position between open and closed and the locking mechanism is unlocked or released (FIGS. 3B-5), the rotational wedge locking mechanism is in a second released position, the lock bar 20 is in a second released position, and the lock pin 48 is in a second released position. When the locking mechanism is in the second released position, the first side of the lock pin 48 is positioned against a curved surface 56 of the tang 40 such that the blade 4 may pivot around the fixed pivot pin 16. Additionally, the lock pin 48 is positioned in a central portion of the slot 36 of the handle 30 when the lock bar 20 is in the second released position and at least a part of the fixed pivot pin 16 is positioned within a forward portion of the slot 37 of the lock bar 20.

When the folding knife 2 is in a closed position (FIGS. 2 and 6), the locking mechanism is in a third resting position, the lock bar 20 is in a third position and the lock pin 48 is in a third position. When the folding knife 2 is in a closed position, the notch 18 in the tang 40 of the blade 4 engages the lock pin 48, thereby creating an additional safety feature which inhibits the inadvertent opening of the blade 4.

When the user wants to rotate the blade 4 from the closed position to the open position, the user may pull the blade 4 out of the handle 30, and possibly even pull on a finger aperture 28 in the blade 4. As the blade 4 rotates to the open position, the notch 18 in the tang 40 carries the lock pin 48 around the fixed pivot pin 16 to a lower, rear portion of the slot 36 in the handle 30 until the tang 40 rotates past a point where the notch 18 can no longer carry the lock pin 48 (see FIG. 7). At this point, the notch 18 releases the lock pin 48, the lock pin 48 is pulled upwardly within the slot 36 of the handle by a leaf spring 22, and the blade 4 is free to rotate about the fixed pivot pin 16 to an open position.

Figure 3A:
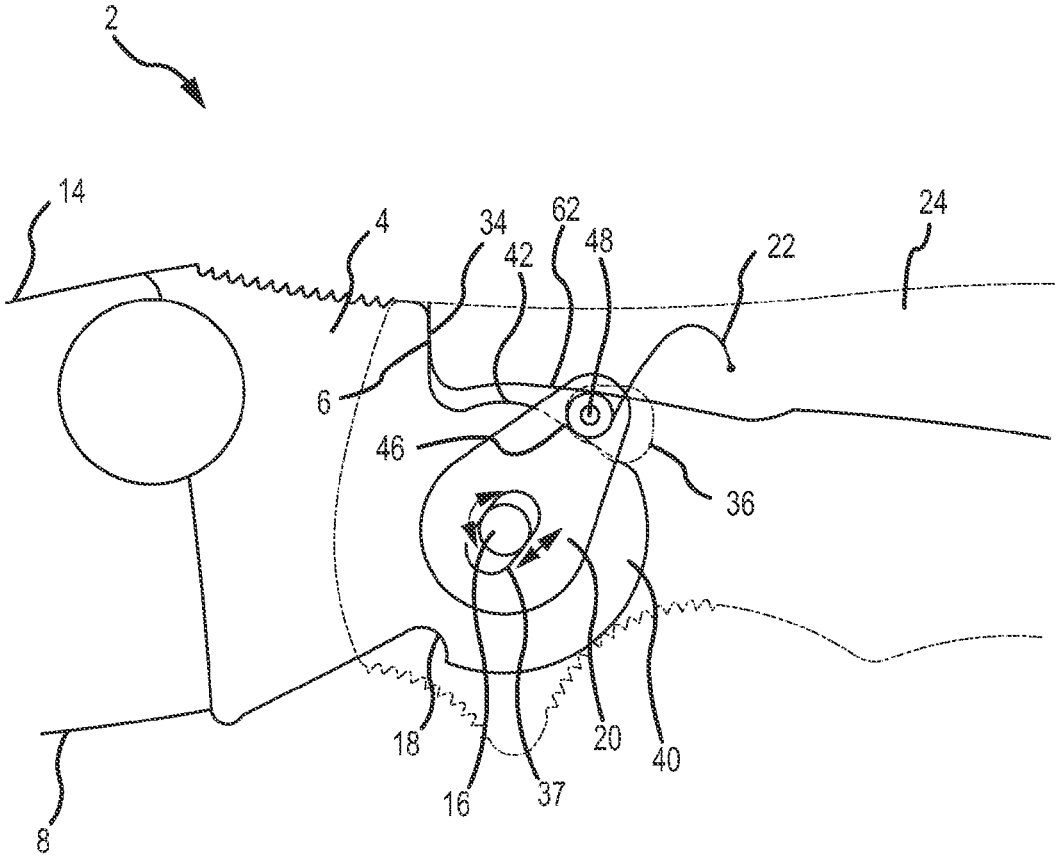
FIG. 3A is a front sectional view of a locking mechanism for a folding knife, with the locking mechanism shown in a locked position.

FIG. 3A shows the section of the folding knife 2 comprising the roto wedge locking mechanism when the blade 4 of the folding knife 2 is in an open, extended position of use. In this embodiment, the roto wedge locking mechanism comprises a lock pin 48, a lock bar 20 with a slot 37, a leaf spring 22, and a lower surface 62 of a back spacer 24. The roto wedge locking mechanism engages a flat surface 46 of a tang 40 of the blade 4 to prevent rotation of the blade 4 around a fixed pivot pin 16. The flat surface 46 of the tang 40 may be upwardly oriented or oriented upwardly and at an angle. The tang 40 may further comprise a bump 42 to reduce the space between the back spacer 24 and the tang 40 such that the bump 42, flat surface 46, and back spacer 24 form a "wedge" for receiving the lock pin 48. The bump 42 may extend upwardly from the tang 40 and may be interconnected to the flat surface 46 of the tang 40. The lock pin 48 is further prevented from traveling past the bump 42 and farther into the wedge-like space between the tang 40 and the back spacer 24. In some embodiments, a third surface of the lock pin 48 may engage the bump 42 on the tang 40. When the folding knife blade 4 is in a first extended position of use, the roto wedge locking mechanism is in a first locked position, the lock bar 20 is in a first locked position, and the lock pin 48 is in a first locked position. Here, the lock pin 48 is positioned in a forward portion of a slot 36 in the handle 30 and the fixed pivot pin 16 is positioned within a central portion of the slot 37 of the lock bar 20.

When the blade is fully extended, a first side of the lock pin 48 engages a flat surface 46 the tang 40 of the blade 4 and a second side of the lock pin 48 engages a lower surface 62 the back spacer 24 to lock the blade 4 into an open position and prevent rotation of the blade. Thus, the lock pin 48 is in compression with the tang 40 and the back spacer 24 is in compression with the lock pin 48. The back spacer 24 comprises a lower surface 62, which engages one or more components of the rotational wedge locking mechanism, e.g., the second surface the lock pin 48, and comprises a stop surface 34 (sometimes called a blade over-travel surface), which engages a vertical edge 6 of the blade 4 to prevent the blade heel end from overextending when the blade 4 is in an extended position of use. The stop surface 34 is positioned above the tang 40 and eliminates the need for a stop pin because it provides the necessary obstacle to prevent the blade 4 from being driven upward or over rotated when a significant, upward force is applied to the blade cutting edge 8. Alternatively, a stop pin could be used to prevent over-travel of the blade 4. Thus, when upward pressure is applied to the blade 4, the blade 4 is prevented from rotating past its open and extended position by the blade's vertical edge 6 and the stop surface 34 of the back spacer 24. Additionally, when downward pressure is applied to the blade 4, the blade 4 is secured by the rotational wedge locking mechanism and prevented from inadvertently rotating. The dual role of the back spacer 24 can clearly be seen in FIG. 3A, where (1) the blade 4 is prevented from overextending (rotating in a clockwise direction as viewed in FIG. 3A) due to the contact between the vertical edge 6 of the blade 4 and the stop surface 34 of the back spacer 24 and (2) the blade 4 is further prevented from closing (rotating in a counterclockwise direction as viewed in FIG. 3A) due to the contact between the lock pin 48 and both the lower surface 62 of the back spacer 24 and the flat surface 46 of the blade tang 40.

The rotational wedge locking mechanism may comprise a leaf spring 22 in tension to maintain the lock pin 48 in a wedged position between the tang 40 and the back spacer 24 until a rearward force is applied to the lock pin 48 to release it from between the tang 40 and the back spacer 24. Thus, the biasing force of the leaf spring 22 on the lock bar 20 and lock pin 48 is oriented in a forward direction toward the blade 4 of the folding knife 2. In one embodiment, the leaf spring 22 may be coupled to a forward end of the back spacer 24.

Further, the positioning of the lock pin 48, lock bar 20, the leaf spring 22, and the tang 40 of the blade 4 allows for the rotational wedge locking mechanism to be secured and retained to the components described herein, without requiring an additional exterior surface, such as scales. Some embodiments, however, may comprise scales.

This configuration provides several advantages over prior art knives. For example, using compression to engage the lock pin 48, the back spacer 24, and the tang 40 provides greater strength than locking mechanisms of the prior art. The roto wedge locking mechanism is very strong where the force of the lock pin 48 pushes on the tang 40 (specifically the flat surface 46) and on the back spacer 24. Thus, the locking mechanism is safe and secure.

Additionally, in some embodiments, the lock pin 48 may be interconnected to a locking lever (not shown), which is engaged by a user's finger to alternatively lock and unlock the blade 4 to allow the blade 4 to rotate between a first extended position of use and a second closed position. As appreciated by one skilled in the art, the blade locking lever may be comprised of any numerous variations of levers or slides which serve the purpose of rotating the lock bar 20 around the fixed pivot pin 16, sliding the lock bar 20 and/or lock pin 48 along the slot 36 of the handle 30, or sliding the lock bar 20 and the slot 37 of the lock bar 20 linearly along the fixed pivot pin 16.

To disengage the lock pin 48 from between the tang 40 and the back spacer 24, the user must push the lock pin 48 in a rearward direction away from the "wedge" of the rotational wedge locking mechanism. This movement removes the locking pin 48 from between the tang 40 and the back spacer 24. Typically the lock pin 48 is positioned in a forward portion of the knife handle 30 proximate the tang 40 of the blade 4 and fixed pivot pin 16, although it is contemplated that other positions may be effective.

Figure 3B:
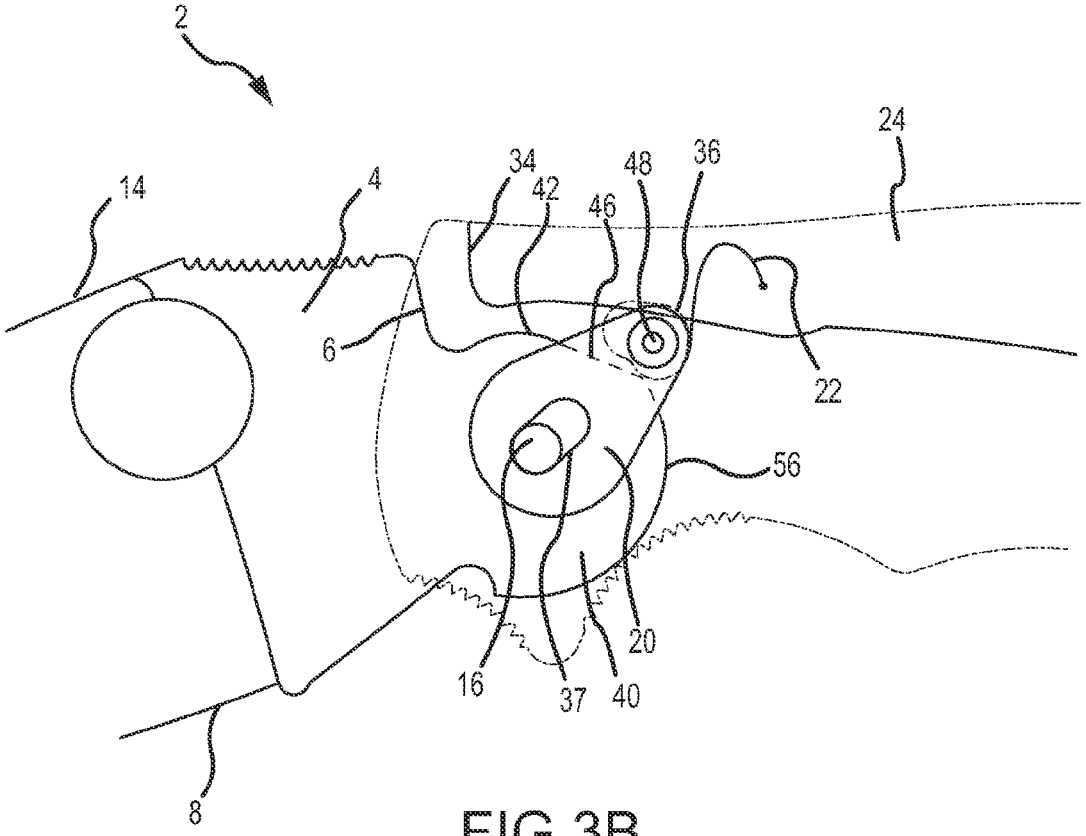
FIG. 3B is a front sectional view of the locking mechanism of FIG. 3 shown in a released position and the blade rotated between an extended position and a closed position.
Figure 4:
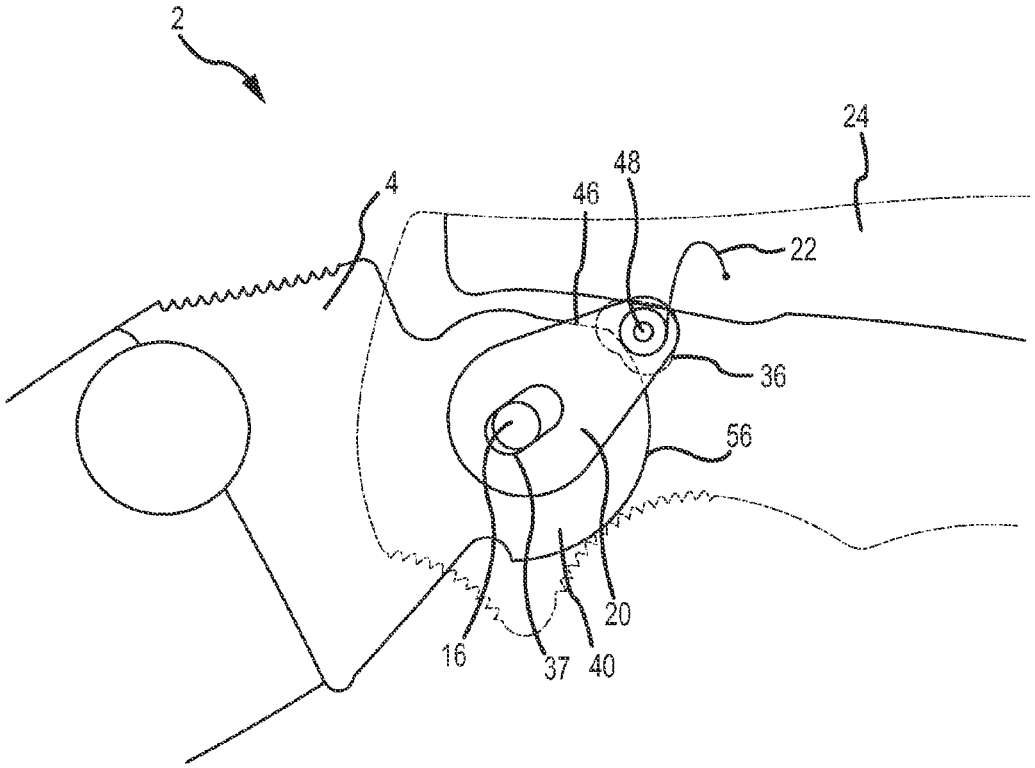
FIG. 4 is a front sectional view of the locking mechanism of FIG. 3A shown in a released position when the blade is rotated closer to the closed position than the blade in FIG. 3B.

FIG. 3B shows the folding knife 2 shortly after the roto wedge locking mechanism has been unlocked and the blade 4 is beginning to be rotated to the closed position. FIG. 4 shows the folding knife 2 while the blade 4 is rotated from the open position to the closed position, i.e., at a point in time after FIG. 3B. Thus, FIGS. 3B and 4 show the folding knife 2 in an intermediate position between open and closed and the roto wedge locking mechanism in a second released position. Here, the lock bar 20 is in a second released position and the lock pin 48 is in a second released position. As the blade 4 rotates between the first extended position and second closed position, the lock pin 48 is positioned in a central portion of the slot 36 of the handle 30 such that the lock pin is no longer touching the lower surface of the back spacer 24. Further, a first side of the lock pin 48 is moved away from the bump 42 and the flat surface 46 of the tang 40 and on to a curved surface 56 of the tang 40, which allows the blade 4 to pivot around the fixed pivot pin 16. As the blade 4 rotates to a closed position, the lock pin 48 slides along the curved surface 56 of the tang 40. When the lock bar 20 is in the second released position, at least a portion of the fixed pivot pin 16 is positioned within a forward portion of the slot 37 of the lock bar 20. Even though the leaf spring 22 is exerting a forwardly oriented force on the lock pin 48, the geometry of the tang and its curved surface 56 prevent the lock pin 48 from moving forward into the forward portion of the slot 36 of the handle 30. As the blade 4 rotates between the first extended position and second closed position, the lock bar 20 moves linearly along the fixed pivot pin 16 and rotates around the fixed pivot pin 16.

Figure 5:
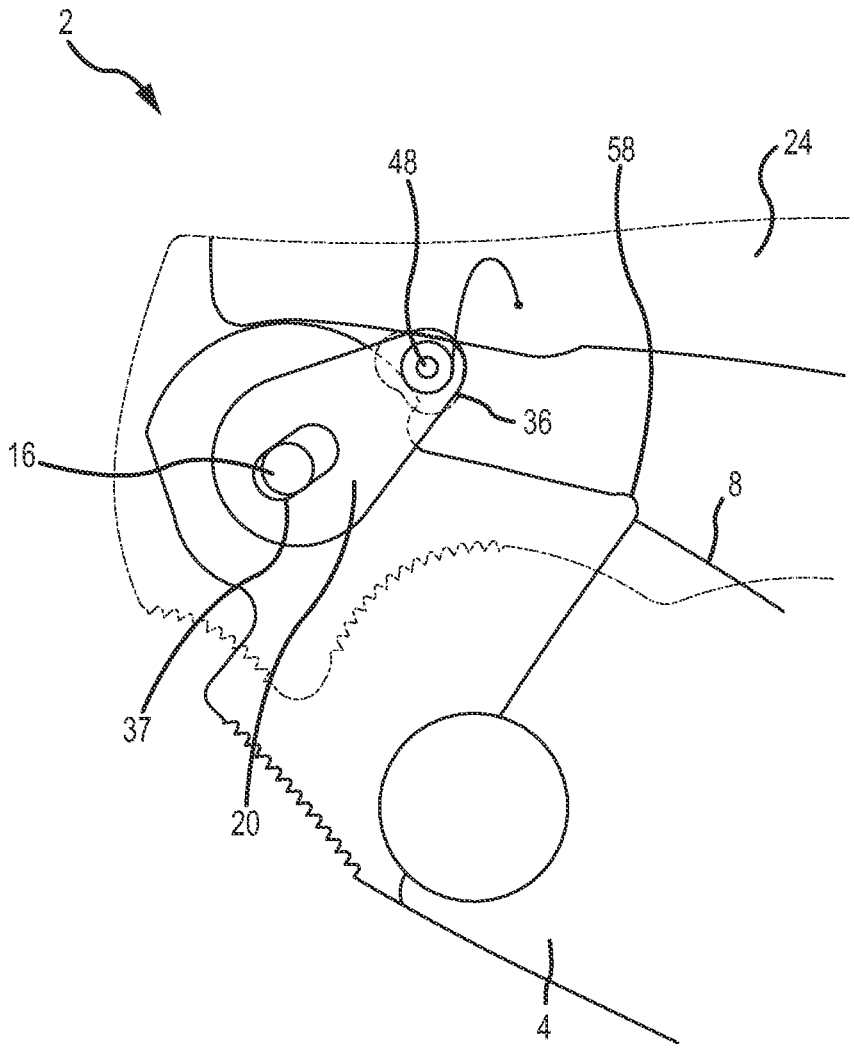
FIG. 5 is a front sectional view of the locking mechanism of FIG. 3A shown in a released position when the blade is rotated closer to the closed position than the blade in FIG. 4.

FIG. 5 shows the locking mechanism of the folding knife 2 when the blade 4 is almost rotated to the closed position, i.e., at a point in time after FIG. 4. Here, the lock pin 48 is positioned in a central portion of the slot 36 of the handle 30 and the lock pin 48 continues to slide along the curved surface 56 of the tang 40 without touching the lower surface of the back spacer 24. Further, at least a portion of the fixed pivot pin 16 remains positioned within a forward portion of the slot 37 of the lock bar 20.

Figure 6:
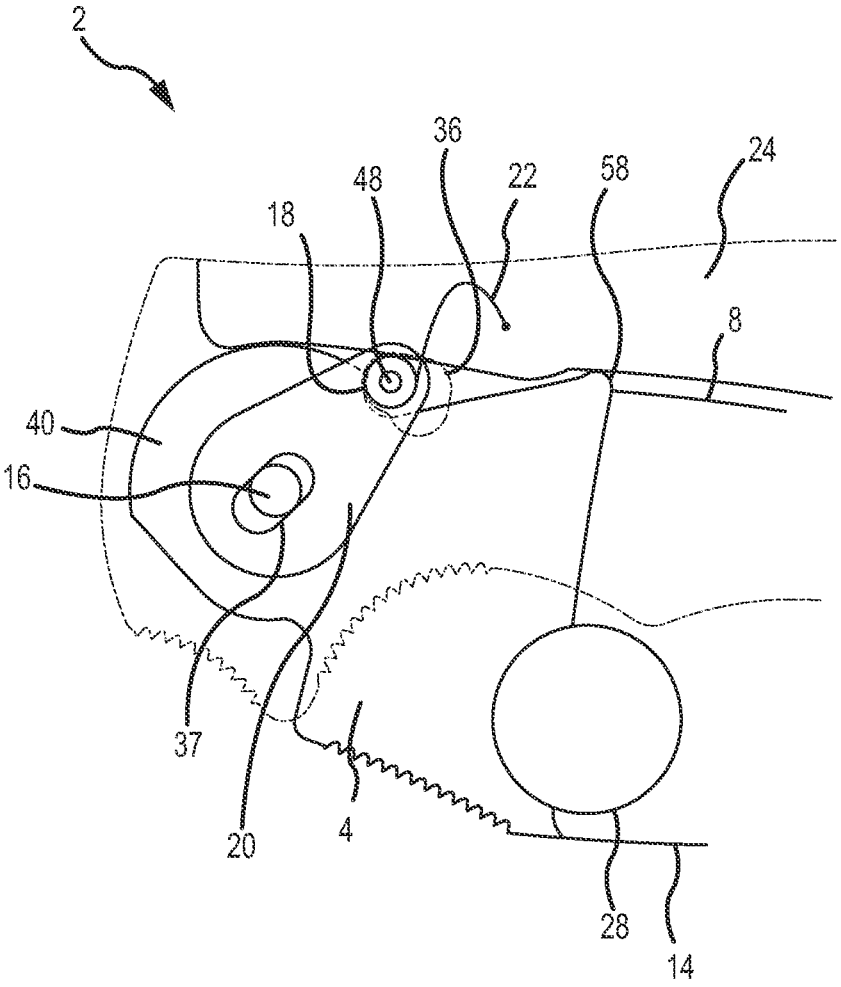
FIG. 6 is a front sectional view of the locking mechanism of FIG. 3A, with the blade shown in a closed position.

FIG. 6 shows the locking mechanism of the folding knife 2 when the blade 4 is in the closed position. In this position, the cutting edge 8 of the blade 4 is retained within the handle and a contact surface 58 of the blade 4 rests against the back spacer 24 to prevent over travel of the blade 4. Here, the roto wedge locking mechanism is in a third resting position, the lock bar 20 is in a third position, and the lock pin 48 is in a third position. More specifically, the lock pin 48 is positioned in a forward portion of a slot 36 in the handle and the fixed pivot pin 16 is positioned in a central portion of a slot 37 of the lock bar 20.

The tang 40 of the blade 4 comprises a notch 18 to engage the lock pin 48 and substantially maintain the blade 4 in a closed position until a user pulls on the spine 14 of the blade 4 or applies finger pressure to a finger aperture 28, thumb stud, or other opening device to allow the blade 4 to rotate from the closed position to the first extended position of use as shown in FIG. 1A. This configuration helps retain the blade 4 in the closed position because the notch 18 in the tang 40 engages the lock pin 48, which inhibits the inadvertent opening of the blade 4. A leaf spring 22 may further bias the lock pin 48 against the notch 18 of the tang 40. In alternate embodiments, a detent and ball could be used to resist opening of the blade when the blade is in a closed position.

Figure 7:
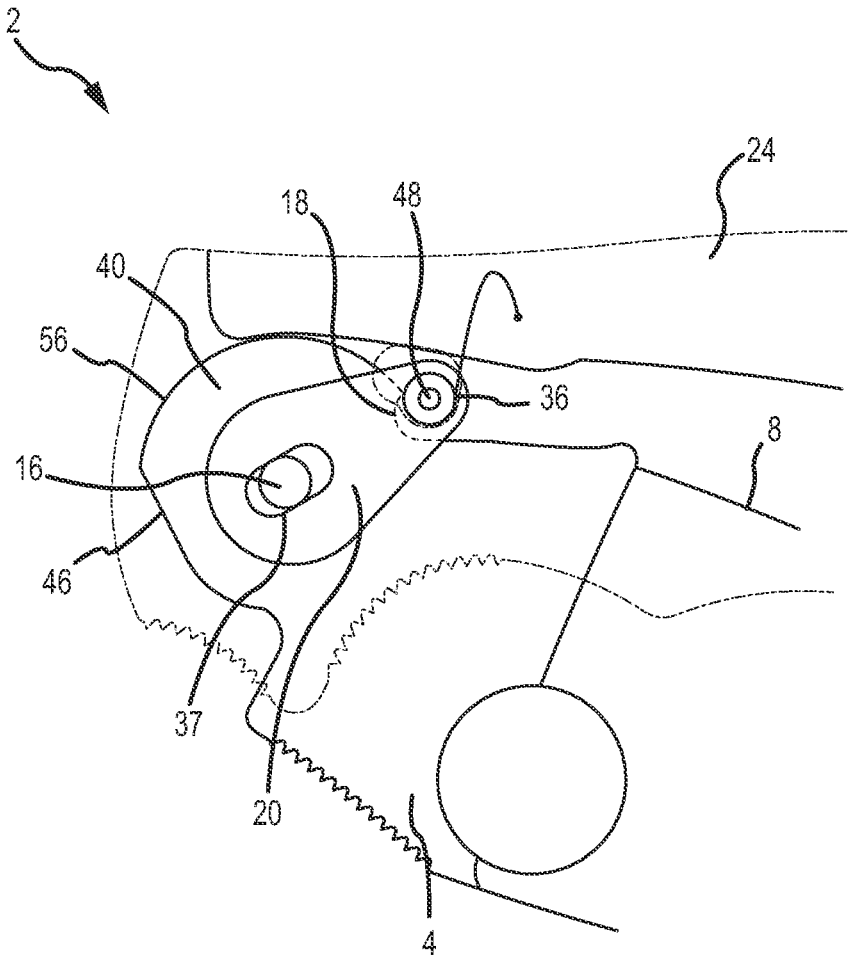
FIG. 7 is a front sectional view of the locking mechanism of FIG. 3A shown in a released position as the blade is rotated from a closed position to an extended position.

When the user wants to rotate the blade 4 from the closed position to the open position, the user may pull the blade 4 out of the handle 30 and possibly even pull on the spine 14 of the blade 4 or a finger aperture 28 in the blade 4. FIG. 7 shows the folding knife 2 and locking mechanism shortly after a user has started rotating the blade 4 from the closed position to an open position. As the user rotates the blade 4 to an open position, the notch 18 in the tang 40 carries the lock pin 48 around the fixed pivot pin 16 from the upper, forward portion of the slot 36 in the handle to the lower, rear portion of the slot 36 in the handle until the lock pin 48 cannot rotate or move any further because it has reached the end of the slot 36 in the handle. As the user continues to rotate the blade 4 open, the notch 18 releases the lock pin 48 and FIG. 7 shows the locking mechanism at this release point. As seen in FIG. 7, the fixed pivot pin 16 is positioned within a central portion of the slot 37 of the lock bar 20. As the blade 4 is rotated further toward the open position, the lock pin 48 is pulled upwardly within the slot 36 of the handle by the leaf spring 22. Now the blade 4 is free to rotate about the fixed pivot pin 16 to an open position while the lock pin 48 slides along the curved surface 56 of the tang 40 as is shown in FIGS. 3B-5.

Figure 8:
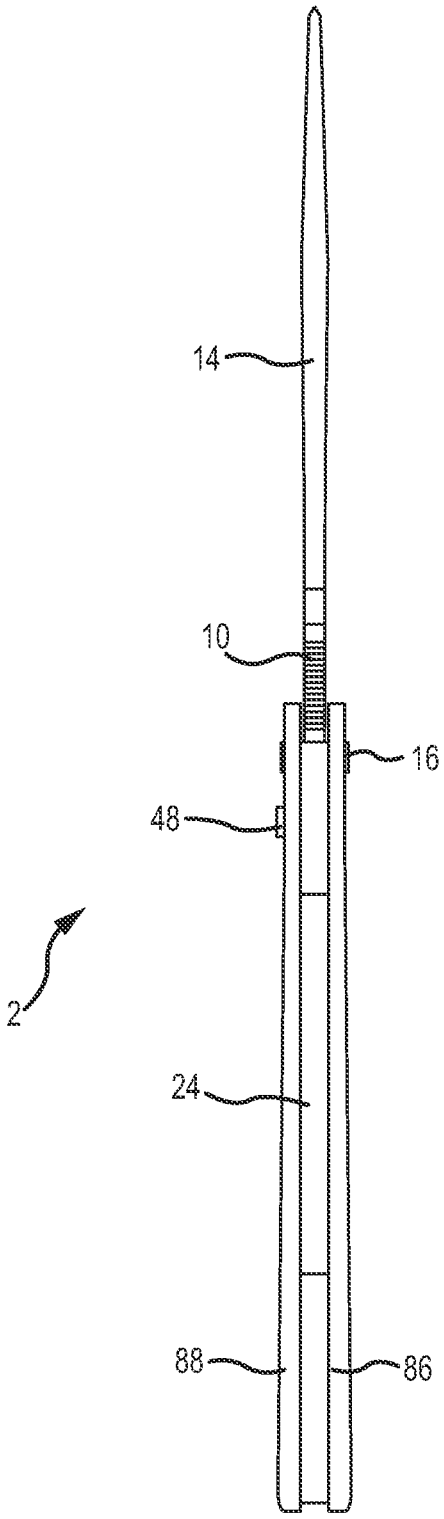
FIG. 8 is top plan view of the folding knife with the blade shown in an extended position.

FIG. 8 is a top plan view of a folding knife 2. The folding knife 2 may comprise a blade, a blade pivot point 16 (e.g., a pin or rivet), a lock pin 48, a back spacer 24, a right scale 86, and a left scale 88. The blade may comprise a spine 14 and a thumb traction portion 10.

Figure 9:
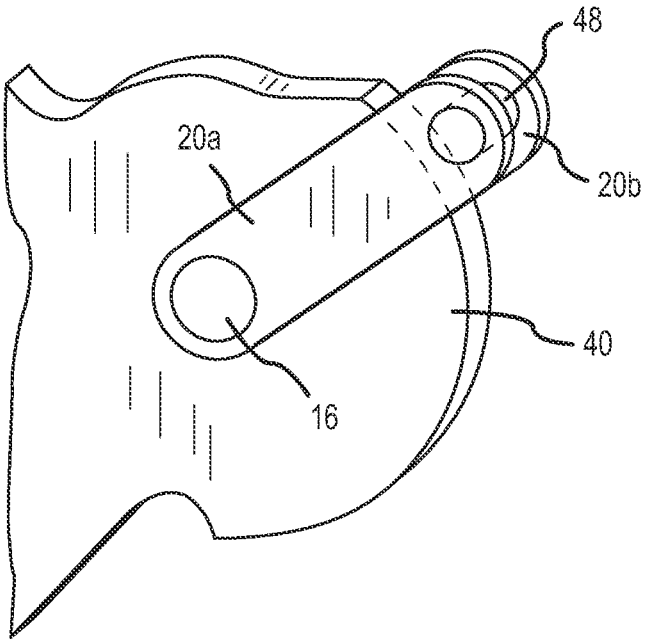
FIG. 9 is a prospective view of a second embodiment of a locking mechanism for a folding knife.

FIG. 9 is a perspective view of an alternate embodiment of the rotational wedge locking mechanism. The dotted lines show portions of components hidden behind other components. The locking mechanism comprises two oval-shaped lock bars 20*a*, 20*b* and a lock pin 48, which work together with a fixed pivot pin 16, and a tang 40 of a knife blade. In alternate embodiments, the lock bars 20*a*, 20*b* may be other shapes or sizes. Additionally, the lock pin 48 may be larger or smaller than is shown in the drawings and may be shaped differently, e.g., square-shaped, oval-shaped, etc. The tang 40 may also be shaped differently than is shown in the drawings. For example, the tang may have a larger flat surface or it may have a second notch instead of the flat surface.

Also note that the lock bar and lock pin shown in the drawings are for illustrative purposes only. One novel feature of embodiments of the present invention is to lock a folding knife 2 in an open and extended position by wedging an item between the tang 40 of the blade 4 and the back spacer 24 or other non-moving object. Thus, the lock pin may be any shape, e.g., square-shaped, rectangular, ovular, or any other shape in cross-section, which serves the function of preventing rotation of the knife blade 4 as a result of the interference between the tang 40 and the back spacer 24. Additionally, in certain embodiments, the lock pin may not necessarily extend through a slot in the side of one or more scales 86, 88. Rather, the lock pin 48 can be positioned between the scales 86, 88, and may even be concealed by the scales, and interconnected to a mechanism the user uses to move the lock pin to unlock the blade 4 and rotate the blade 4 to a closed position. For example, the lock pin (or other item wedged between the tang 40 and back spacer 24 to lock the blade 4 in an open position) can be interconnected to a thumbwheel. The thumbwheel can, in some embodiments, be formed out of one or both of the lock bars 20. Further, the thumbwheel can be positioned between the scales 86, 88 and extend outwardly beyond the scales 86, 88 at one or more locations (e.g., out of the top of the handle) such that a user can turn the thumbwheel to release the lock pin 48 and thus release the blade 4 from its open and locked position. In alternate embodiments, the lock pin 48 may be interconnected to a cable, lever, or other remote device that the user can use to move the lock pin 48 to the unlocked position allowing the blade 4 to rotate to the closed position. In another embodiment, the lock pin 48 can be interconnected to a lever which is partially exposed so that the user can manipulate the lock pin 48. Thus, at least a portion of the lever is accessible by the user such that the user can manipulate the lever to move the lock pin 48. Accordingly, the lock pin or other wedging item can be manipulated by the user through a variety of mechanisms.

Thus, the folding knife 2 comprises a means of moving the locking mechanism from a first locked position to a second unlocked or released position. Additionally, the folding knife 2 comprises a means of moving the lock pin or other wedging item from a first locked position (wedged between the tang 40 and back spacer 24) to a second released position (not wedged between the tang 40 and back spacer 24).

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A folding knife with a selectively releasable locking mechanism, comprising:

a blade moveable from a first extended position to a second closed position and having a front end, a tang on a rear end, a spine, and a cutting edge;

a handle having a slot, a cavity for receiving a portion of said blade, and a back spacer, wherein said blade is pivotally interconnected to a forward end of said handle with a pin;

a locking mechanism moveable from a first locked position to a second released position, said locking mechanism comprising:

a lock bar positioned proximate to said forward end of said handle, said lock bar having a slot and said pin positioned within said slot of said lock bar, wherein said lock bar is moveable both in a rotational direction around said pin and linearly with respect to said pin; and a lock pin interconnected on a distal end of said lock bar, wherein said lock pin extends outwardly from said handle through said slot of said handle for engagement with a user's fingers;

wherein when said blade is in said first extended position, a first side of said lock pin engages a first upwardly-oriented surface of said tang and a second side of said lock pin engages a lower surface of said back spacer to substantially impede the blade from rotation; and wherein when said locking mechanism is in said second released position, said lock pin disengages said first upwardly-oriented surface of said tang and disengages said lower surface of said back spacer to allow rotation of said blade from the first extended position to the second closed position.

2. The knife of claim 1, wherein said lock bar has a teardrop shape.

3. The knife of claim 1, further comprising a biasing member which biases said lock pin upwardly and forwardly.

4. The knife of claim 1, wherein when said locking mechanism is moved from said first locked position to said second released position, said lock bar moves linearly with respect to said pin and said lock bar rotates around said pin.

5. The knife of claim 1, wherein said lock pin disengages said first upwardly-oriented surface of said tang when said lock pin is pushed in a rearward direction.

6. The knife of claim 1, wherein when said locking mechanism is in said second released position said lock pin engages a curved surface of said tang to allow rotation of said blade.

7. The knife of claim 1, wherein when said blade is in said second closed position a notch portion of said tang engages said lock pin to resist opening.

8. The knife of claim 1, wherein said lock pin is in compression with said first upwardly-oriented surface of said tang and said lower surface of said back spacer when said blade is in said first extended position.

9. The knife of claim 1, further comprising a second lock bar interconnected to said lock pin, wherein said first lock bar is positioned on a first side of said tang and said second lock bar is positioned on a second side of said tang.

10. A folding knife with a locking mechanism, comprising:

a blade having a front end, a tang on a rearward end, an upper edge, a cutting edge, and an aperture extending through said tang;

a pin extending through said aperture, wherein said blade rotates around said pin;

a handle comprising a back spacer, a first scale, and a second scale, wherein said tang of said blade is pivotally interconnected to a forward end of said handle at said pin;

a locking mechanism comprising a lock bar and a lock pin, said locking mechanism pivotally interconnected to said handle for selectively locking said blade in a first extended position and selectively allowing said blade to rotate to a second closed position, said lock pin interconnected to an end portion of said lock bar;

a space between said tang and said back spacer;

a flat surface of said tang;

a first surface of said lock pin adapted to provide a compression force against said flat surface of said tang when said blade is in said first extended position;

a second surface of said lock pin adapted to provide a compression force against a lower surface of said back spacer when said blade is in said first extended position;

wherein when said blade is in said first extended position, said space reduces in size in a forward direction and said lock pin is positioned in said space; and wherein when said lock pin is pushed rearwardly, said lock pin disengages said flat surface of said tang and said lower surface of said back spacer to allow rotation of said blade.

11. The knife of claim 10, further comprising a biasing member interconnected to said lock pin and said back spacer, wherein said biasing member biases said lock pin in a forward position.

12. The knife of claim 10, wherein said back spacer is positioned between said first and second scales, and wherein said first and second scales define a channel for receiving at least a portion of said blade.

13. The knife of claim 10, wherein said lock pin disengages said flat surface of said tang when said lock pin is pushed in a rearward direction.

14. The knife of claim 10, wherein when said blade is in said second closed position, a notch portion of said tang engages said lock pin.

15. The knife of claim 10, wherein said lock bar further comprises a slot to engage said pin and to allow for linear and rotational movement of said lock bar around said pin.

16. The knife of claim 10, further comprising a second lock bar interconnected to said lock pin, wherein said first lock bar is positioned on a first side of said tang and said second lock bar is positioned on a second side of said tang.

17. The knife of claim 16, wherein said first scale comprises a cutout shaped to accommodate said first lock bar, and wherein said second scale comprises a cutout shaped to accommodate said second lock bar.

18. A folding knife with a locking mechanism, comprising:

a first lock bar positioned proximate to a tang of a blade, said first lock bar having a slot;

a first pin positioned within said slot of said first lock bar, wherein said first lock bar is moveable in a rotational direction around said first pin and linearly with respect to said first pin;

a lock pin interconnected to said first lock bar and positioned proximate to an end of said first lock bar, wherein said lock pin extends outwardly from a handle through a slot of said handle;

a biasing member which biases said lock pin upwardly and forwardly;

wherein when said blade is in a first extended position, a first side of said lock pin engages a first upwardly-oriented surface of said tang and a second side of said lock pin engages a lower surface of a back spacer;

wherein when said locking mechanism is in a second released position, said lock pin disengages said first upwardly-oriented surface of said tang and disengages said lower surface of said back spacer; and wherein when said blade is in a second closed position, a notch portion of said tang engages said lock pin.

19. The knife of claim 18, wherein said lock pin disengages said first upwardly-oriented surface of said tang and said lower surface of said back spacer when said lock pin is pushed in a rearward direction, and wherein when said blade is in said first extended position a third surface of said lock pin engages a bump on said tang.

20. The knife of claim 18, further comprising a second lock bar having a slot and positioned proximate to said tang of said blade, wherein said first pin is positioned within said slot of said second lock bar, and wherein said lock pin is interconnected to said second lock bar and positioned proximate to an end of said second lock bar.

* * * * *